US007724130B2

(12) United States Patent
Norstrom et al.

(10) Patent No.: US 7,724,130 B2
(45) Date of Patent: May 25, 2010

(54) SYSTEMS AND METHODS FOR DISTRIBUTING EMERGENCY MESSAGES

(75) Inventors: Pauline Norstrom, Warrington (GB); Michael Newton, Manchester (GB)

(73) Assignee: AD Group, Warrington (GB)

( * ) Notice: Subject to any disclaimer, the term of this patent is extended or adjusted under 35 U.S.C. 154(b) by 495 days.

(21) Appl. No.: 11/656,822

(22) Filed: Jan. 23, 2007

(65) Prior Publication Data

US 2007/0210910 A1 Sep. 13, 2007

Related U.S. Application Data

(60) Provisional application No. 60/761,112, filed on Jan. 23, 2006.

(51) Int. Cl.
*G08B 29/00* (2006.01)

(52) U.S. Cl. ..... 340/506; 340/523; 340/539.11; 340/539.26; 340/3.1; 340/825.36; 340/825.49

(58) Field of Classification Search ..... 340/506, 340/517, 521, 522, 523, 524, 525, 539.1, 340/539.11, 539.26, 3.1, 825.36, 825.49
See application file for complete search history.

(56) References Cited

U.S. PATENT DOCUMENTS

| | | | |
|---|---|---|---|
| 3,975,583 | A | 8/1976 | Meadows |
| 4,155,042 | A | 5/1979 | Permut et al. |
| 4,862,268 | A | 8/1989 | Campbell et al. |
| 5,027,211 | A | 6/1991 | Robertson |
| 5,260,778 | A | 11/1993 | Kauffman et al. |
| 5,495,283 | A | 2/1996 | Cowe |
| 5,760,820 | A | 6/1998 | Eda et al. |
| 6,529,230 | B1 | 3/2003 | Chong |
| 6,543,051 | B1 | 4/2003 | Manson et al. |
| 6,698,021 | B1 | 2/2004 | Amini et al. |
| 6,700,602 | B1 | 3/2004 | Blair |

(Continued)

FOREIGN PATENT DOCUMENTS

| | | |
|---|---|---|
| WO | WO-0152512 | 7/2001 |

(Continued)

OTHER PUBLICATIONS

How Vigilos ESM Works, website: http://www.vigilos.com/product_how.html, acessed Oct. 11, 2005, 3 pp.

(Continued)

*Primary Examiner*—Daryl Pope
(74) *Attorney, Agent, or Firm*—Goodwin Procter LLP

(57) ABSTRACT

The invention relates to systems and methods for providing customized, event-triggered messages in response to emergency events, such as natural disasters and man-made events. The methods and systems provide a set of messages related to responding to the emergency event and a set of rules relating to the distribution of the messages, receive an indication that the emergency event has occurred, and in response to the indication, transmit at least one of the messages to at least one message receiver based at least in part on at least one attribute of the message receiver to at least one of instruct and inform recipients of the messages of the emergency event and the action to be taken in response to the emergency event.

27 Claims, 4 Drawing Sheets

U.S. PATENT DOCUMENTS

| | | | | |
|---|---|---|---|---|
| 6,765,991 | B1 | 7/2004 | Hanuschak et al. | |
| 6,778,081 | B2 * | 8/2004 | Matheny | 340/506 |
| 6,781,509 | B1 * | 8/2004 | Oppedahl et al. | 340/286.01 |
| 6,844,818 | B2 | 1/2005 | Grech-Cini | |
| 6,930,596 | B2 * | 8/2005 | Kulesz et al. | 340/506 |
| 6,937,147 | B2 * | 8/2005 | Dilbeck et al. | 340/506 |
| 6,956,485 | B1 | 10/2005 | Aird et al. | |
| 6,958,709 | B2 | 10/2005 | Izbicki et al. | |
| 6,975,220 | B1 * | 12/2005 | Foodman et al. | 340/531 |
| 7,002,478 | B2 | 2/2006 | Moore et al. | |
| 7,009,510 | B1 * | 3/2006 | Douglass et al. | 340/531 |
| 7,046,140 | B2 * | 5/2006 | Adamczyk et al. | 340/539.18 |
| 7,130,389 | B1 | 10/2006 | Rodkey et al. | |
| 7,148,795 | B2 * | 12/2006 | Dilbeck et al. | 340/506 |
| 7,174,005 | B1 | 2/2007 | Rodkey et al. | |
| 7,277,018 | B2 * | 10/2007 | Reyes et al. | 340/573.1 |
| 7,362,852 | B1 | 4/2008 | Rodkey et al. | |
| 7,418,085 | B2 | 8/2008 | Rodkey et al. | |
| 7,496,183 | B1 | 2/2009 | Rodkey et al. | |
| 7,519,165 | B1 | 4/2009 | Rodkey et al. | |
| 2002/0005894 | A1 | 1/2002 | Foodman et al. | |
| 2002/0118118 | A1 | 8/2002 | Myllymaki et al. | |
| 2003/0012344 | A1 | 1/2003 | Agarwal et al. | |
| 2003/0216133 | A1 | 11/2003 | Poltorak | |
| 2004/0044553 | A1 | 3/2004 | Lambert et al. | |
| 2004/0103431 | A1 | 5/2004 | Davenport et al. | |
| 2004/0145481 | A1 * | 7/2004 | Dilbeck et al. | 340/573.1 |
| 2005/0015222 | A1 | 1/2005 | Harrington | |
| 2005/0049789 | A1 | 3/2005 | Kelly et al. | |
| 2005/0245232 | A1 | 11/2005 | Jakober et al. | |
| 2007/0121800 | A1 | 5/2007 | Rodkey et al. | |

FOREIGN PATENT DOCUMENTS

| | | |
|---|---|---|
| WO | WO-0209353 | 1/2002 |
| WO | WO-03077063 | 9/2003 |

OTHER PUBLICATIONS

DVMR Digital Video Multiplex Recorders-user manual Manufacturer: Dedicated Miros, dated Oct. 2004, 12 pp.

International Search Report for PCT/IB2007/002164 dated Jan. 3, 2008, 4 pp.

* cited by examiner

SYSTEMS AND METHODS FOR DISTRIBUTING EMERGENCY MESSAGES

CROSS-REFERENCE TO RELATED APPLICATIONS

This application claims the benefit of and priority to U.S. Provisional Patent Application Ser. No. 60/761,112, filed on Jan. 23, 2006, the entire disclosure of which is hereby incorporated by reference herein.

FIELD OF THE INVENTION

This invention relates generally to broadcasting emergency messages and, more particularly, to broadcasting customized event-driven messages to various recipients.

BACKGROUND

In recent years, the resources dedicated to disaster preparedness and response have increased significantly. One key aspect of emergency and disaster management involves being able to provide up to date, accurate information to people such that the information is actionable. Typical methods for providing information to large populations include radio and television broadcasts, updates to internet sites, and generic text-based messages.

Conventional messaging systems, however, are triggered by known or commonly encountered events such that the recipient can either anticipate the event (e.g., a late flight arrival) or the instructions for responding to the event are not specific to the individual (e.g., taking an alternate route when a current route is congested). Such generic messages are not, however, adequate for providing actionable instructions to a diverse audience of recipients regarding how to respond to catastrophic events.

There is, therefore, a need for methods and systems for providing customized, actionable messages to individuals and/or devices based on the occurrence of a catastrophic event based on attributes of the device, the event, and the recipient, which may or may not be known prior to the occurrence of the event.

SUMMARY

The present invention is directed to techniques for providing customized, event-triggered messages in response to unplanned events such as natural disasters (e.g., earthquakes, hurricanes, blizzards, etc.) as well as man-made events such as terrorist attacks, traffic jams, and others. In one example, a method in accordance with the invention includes the steps of receiving a first signal representative of an event and, in response, sending a predetermined signal to a receiving location. The signal can be used, for example, to either send a site specific message, to trigger a prerecorded message preloaded at the receiving station, or otherwise generate a customized message at the receiving location. The methods and systems described herein can be implemented as a stand-alone system or can be integrated with an existing security or disaster planning infrastructure to enhance their capabilities. For example, the systems and methods can be used over a reverse channel of an existing network.

Generally, the invention facilitates the delivery of customizable messages to message receivers or generation of messages at the message receivers in response to the occurrence of an event. The delivery features and content of the messages are based on attributes of the device, the event, the person or organization associated with the device, and any combination thereof. The messages are authored using combinations of static text, dynamic text, still video, motion pictures, and/or audio and can be sent via a network or preloaded at the message receivers. Rules determine when, how, and to whom the messages are sent and displayed, as well as what content should be included or excluded from particular messages. Upon detection of an event, the rules are used to compile and/or determine the messages appropriate for that particular event (e.g., an earthquake during business hours in a large city) and distribute/display the messages accordingly. Continued detection and surveillance of the affected areas (as well as other locales, such as evacuation centers and key infrastructure locations) can provide additional signals, such that subsequent messages can be compiled and distributed with updated instructions and information. Post-event, the messages and rules can be updated (e.g., changed, deleted, added) based on lessons learned from the event such that subsequent messages are more accurate and more informative.

In one aspect, the invention relates to a method for providing information related to an event. The method includes providing a set of messages relating to responding to an unforeseen or emergency event (e.g., a disaster or catastrophic event) and rules relating to the content and distribution of the messages, receiving an indication of an occurrence of the event and, in response, transmitting messages that are customized based on attributes of the receiving device to at least one of instruct and inform recipients of the messages of the event and the action to be taken in response to the event.

In one embodiment, the method further includes receiving subsequent indications of events (either related or unrelated to the initial event) and transmitting subsequent messages to the message receivers or generating subsequent messages at the message receiver in response thereto. The subsequent messages can be, for example, the same as or in some cases variations of the originally transmitted message, and can relate to the status of the event. The rules relating to the distribution of the messages can include information related to attributes of the event, the message receiver, and/or a person or persons to which the message receiver has been registered. In some embodiments, the rules can embody forward-chaining and/or backward-chaining processes to determine an appropriate message based on a set of data. The message can be used to instruct official and non-official personnel as to what action to take. For example, a message may be sent via the Internet to a closed-circuit television system of a building to alert building security and instruct residents of the building to evacuate, while simultaneously sending a message to emergency personnel to instruct the emergency personnel to proceed to the building. Additionally, the system could send messages to cell phone users, based on their location, to avoid the area of the emergency.

Non-limiting examples of attributes on which the rules can be based include geographic attributes of the receiver (current location, home location, speed and direction of travel, etc.), classification attributes of the message (e.g., critical, high-importance, medium-importance, and informational) and/or temporal attributes (certain messages may be sent immediately upon notification of an event, whereas other messages may be sent at some time subsequent to or some periodicity after the event). Rules can also be based on attributes of the event itself, such that the type of event, the time of the event, and the location of the event are considered either individually or in some combination when compiling and distributing the messages. In addition, the rules can encompass various functional attributes of the message receivers such that certain messages may include still or moving video, audio and/or text.

The message receivers can be located at a fixed location and/or transitory, can be addressed using unique network and/or hardware addresses, and receive the messages over one or more wired and/or wireless communications networks operating at various frequencies and channels such as radio signals, television signals, and private and public computer networks (including the Internet). In some embodiments, the messages are formatted using a markup language and associated tags (e.g., SGML, HTML and XML) and rendered by the message receivers. The messages can also include functionality provided by geographic information systems (GIS) such as map overlays. In some embodiments, the messages are unique to a specific message receiver. Updated attributes of the message receivers (e.g., a new location) can be used to alter the content and/or delivery instructions related to a message as the event unfolds or the situation dictates. Where individual addressing is not available, the data storage and rules can be embodied at the receiver, allowing for individual customization of the message displayed based on the rules and attributes, derived from a common or triggering message.

Other embodiments provide for the indication of the event to be detected by one of the message receivers, such as an audio broadcast device that also includes smoke detection capabilities. The occurrence of the event can be indicated via a telephone call (either human initiated or automated), an instant message, an email, a video signal, an audio signal or other electronic signals generated in response to vibration, excessive heat, loss of power, the undesired presence of water or other anomalies. For example, the messages can be modified as the event unfolds and is witnessed via, for example, a closed circuit television system.

In another aspect, the invention relates to a system for providing messages relating to the occurrence of an event. The system includes a data storage module for storing messages related to responding to an event and rules pertaining to the compilation and distribution of the messages, a receiver for receiving an indication that an event occurred, a rules engine for interpreting the rules such that the messages are compiled and addressed or displayed pursuant to the rules, and a transmitter for distributing the messages in accordance with the rules, for example, transmitting one or more of the messages to one or more message receivers based at least in part on one or more attributes of the message receivers to at least one of instruct and inform recipients of the messages of the emergency event and the action to be taken in response to the emergency event.

In some embodiments, the system includes an authoring module for composing the messages, rules, and/or message templates used to compile the messages. The system can also include a geographic determination module for determining physical locations of the event and/or message receivers, as well as their proximities to each other.

The message receivers can include an audio and/or visual apparatus for detecting an event, receiving a message, and/or replying to a received message. In some embodiments, the reply message includes an updated status of the event, location of the message receiver, a voice message and/or a textual message from an operator of the receiver. The message receivers can also, in some embodiments, provide storage means for storing portions of the messages or in some cases the entire message, and the rules database.

In another aspect, the invention comprises an article of manufacture having a computer-readable medium with the computer-readable instructions embodied thereon for performing the methods described in the preceding paragraphs. In particular, the functionality of a method of the present invention may be embedded on a computer-readable medium, such as, but not limited to, a floppy disk, a hard disk, an optical disk, a magnetic tape, a PROM, an EPROM, CD-ROM, or DVD-ROM, USB storage devices, Flash Cards etc. The functionality of the method may be embedded on the computer-readable medium in any number of computer-readable instructions, or languages such as, for example, FORTRAN, PASCAL, java, javascript, PHP, ASP, AJAX, C, C++, C#, LISP, Tcl, BASIC and assembly language. Further, the computer-readable instructions can, for example, be written in a script, macro, or functionally embedded in commercially available software (such as, e.g., EXCEL or VISUAL BASIC).

These and other objects, along with the advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

In the following, various embodiments of the present invention are described with reference to the distribution of customized messages in response to a catastrophic event. It is, however, to be understood that the present invention can also be used to provide information regarding any event and operate with virtually any type of messaging system. Further, included in the distribution of the messages is the distribution of a signal to trigger messages that are preloaded at the message receivers or to cause customized messages to be generated at the message receivers. The signal or multiple signals can be generated to multiple message receivers to coordinate the messages and responses thereto.

Figure 1:
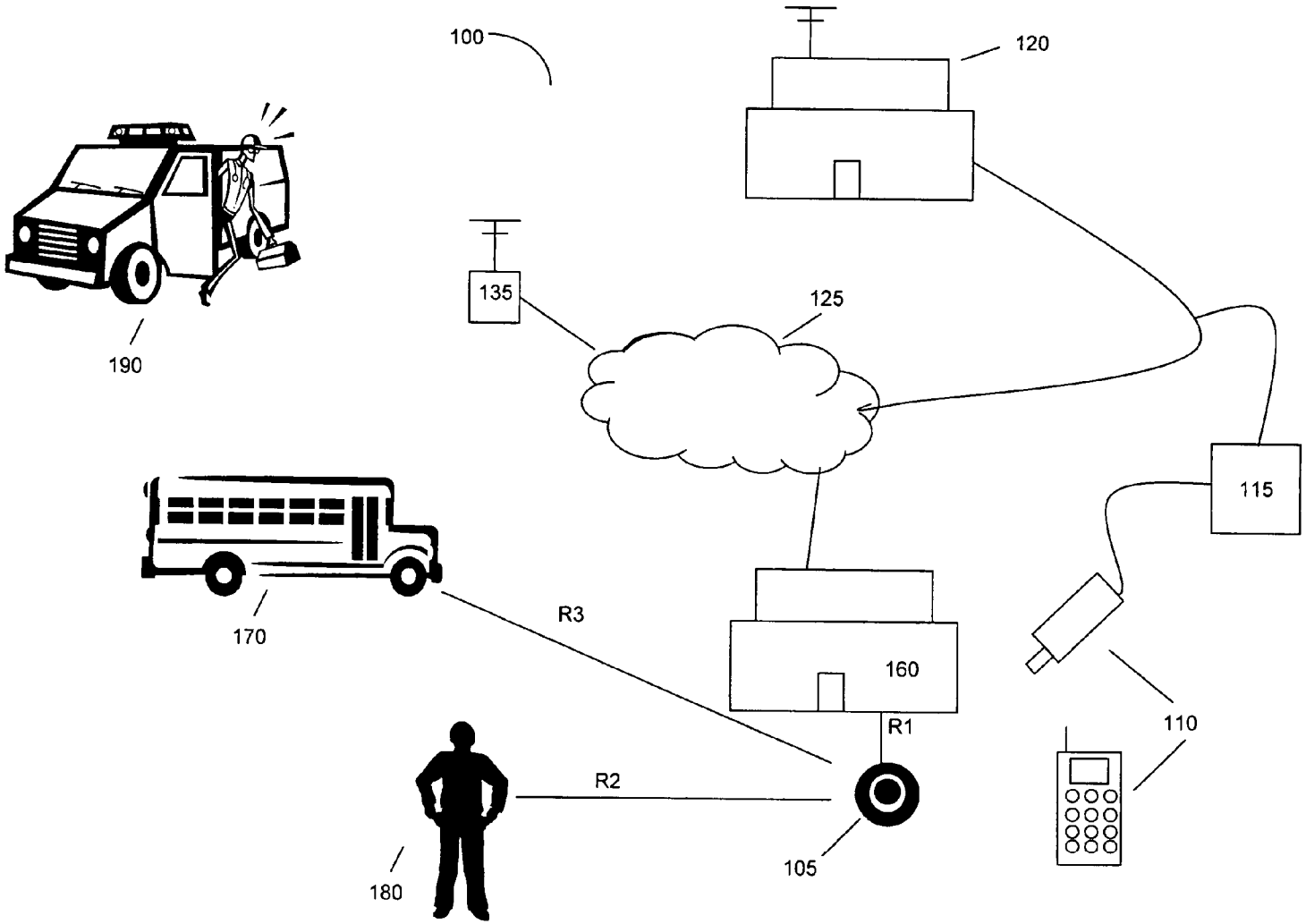
FIG. 1 is an illustration of an environment in which the techniques described herein can be implemented in accordance with one embodiment of the invention.

FIG. 1 is an illustration of an environment 100 in which various embodiments of the techniques and systems described herein can be implemented. As illustrated, environment 100 depicts a typical urban setting; however, the methods and systems of the invention are equally as applicable to other settings as well. Non-limiting examples of environments in which the invention can be implemented include large public gathering areas such as arenas, parks, transportation hubs, universities, military complexes, exhibition complexes, theme parks, and concert halls, as well as others. Within the environment 100, an epicenter 105 geographically identifies the primary location of a catastrophic event such as a fire, bomb explosion, terrorist attack, flood, tornado or other situation where coordinated, planned responses help minimize panic and collateral damage. The epicenter 105 can be identified using one or more of many conventional geographic location techniques, including, but not limited to longitude and latitude coordinates (determined, for example, using GPS technology), grid coordinates, city, county, and state names, and street addresses, as well as other means.

Disposed about the environment 100 and in the vicinity of the epicenter 105 are one or more detection devices 110 for detecting various catastrophic events and initiating alarms or triggers for the messaging capabilities of the system. In some cases, the detection devices 110 can be public call stations requiring manual operation or a video monitoring system that includes various sensors (e.g., cameras, infrared detectors, thermocouples, etc.) dispersed about the environment 100. As one example, video surveillance systems can be used to transmit video signals to a surveillance center 115, where operators monitor video screens for evidence of an event and activate an alarm indicating the occurrence of the event. In other cases, the detection devices 110 can be fully automated and trigger an alarm based on the detection of some anomaly (e.g., fire, radiation, tremors, power loss, water, etc.), thereby eliminating the need for manual actuation where there is no one available or able to trigger an alarm. Examples of such systems include, but are not limited to, intelligent video monitoring systems, seismic monitoring systems, smoke detectors, intrusion alert sensors, and others. Once detected, the appropriate signals are transmitted to a command center 120.

Other attributes of the detection devices 110, such as their geographic location (both in absolute terms and with respect to key locales in the environment 100), messaging modality, and associated businesses are associated with the devices 110. Upon detection of an event by a first device, other devices sharing the same or similar attributes can be activated or queried to confirm the occurrence and gather additional information. For example, if a sensor located in a particular building senses fire, vibrations, or smoke typically associated with an explosion, signals from devices in neighboring buildings or different devices within the same building can be queried and analyzed to determine the scope of the event.

The indication of the occurrence of the event is transmitted from the detection devices 110, the surveillance center 115, or using a device such as a cellular telephone or a PDA to the central command center 120. In some embodiments, the indication is sent in the form of an electronic message that may be encrypted using, for example a shared key or hash function, such that its validity and delivery can be verified at the command center 120. A communications network 125 connects the detection devices 110 with the surveillance center 115 and the command center 120, as well as antennas, repeaters, or other wireless receivers and transmitters 135 that send and receive signals from the detection devices 110. The communication may take place via any media such as standard telephone lines, LAN or WAN links (e.g., T1, T3, 56 kb, X.25), broadband connections (VPN, ISDN, Frame Relay, ATM), wireless links (802.11, Bluetooth, GPRS, 3G, Tetra), commonly used frequencies such as VHF, UHF, FM and AM, paging systems, and so on. The type of network is not a limitation, however, and any suitable network may be used. Typical examples of networks that can serve as the communications network 125 include a wireless or wired Ethernet-based intranet, a local or wide-area network (LAN or WAN), and/or the global communications network known as the Internet, which may accommodate many different communications media and protocols, including TCP/IP protocol communications and HTTP/HTTPS requests.

In some embodiments, the systems and methods described herein can be operated remotely by accessing the command center 120 (or one of many distributed command centers) using secure communication techniques. In some embodiments, the network 125 can carry TCP/IP protocol communications and HTTP/HTTPS requests. The center 120 can include one or more RADIUS servers that utilize secure, encrypted messaging to assure only those with permitted access credentials (tokens, biometric attributes, passkeys, etc.) are allowed to access the system.

The environment 100 also includes numerous entities at varying distances from the epicenter 105. In accordance with the invention, each entity receives messages that provide information and instructions regarding the emergency, such as evacuation instructions, mustering instructions, and other information useful for escaping from, surviving, or assisting with a catastrophic event. An entity can be virtually anything, such as buildings, trains, subway cars, airplanes, cars, buses, police, military, and emergency services, etc., as well as individuals or groups of people. In addition to classifying entities by type as above, entities can also be classified by function (a hospital, office building, school, arena, park, etc.) and geographic radius from the epicenter 105.

In some embodiments, GIS systems can be used to provide interactive maps of a particular area (a large city, for example) and overlay points of interest such as potential targets, escape routes, muster stations, hospitals, key infrastructure elements. Once compiled, the interactive maps can be included in the messages such that the map is continuously updated as the entity receiving the message moves.

The entities are outfitted or assigned one or more message receivers that render and display the messages in the areas and to the people affected by the event. The message receivers can include message boards, radios, video screens, telephones, computers, and means to link to the network 125. Similar to the detection devices 110, attributes of the message devices, such as a home and current location, messaging modality, and owner are associated with the message receivers and stored in a data storage module. The message devices can be fixed (e.g., a display over a highway leading into a city) or transient, such as a cellular telephone or audio notification system in a bus or train. In situations where a message device is fixed, the longitudinal and latitudinal coordinates are stored, and upon detection of an event, the distance between the epicenter 105 and message device can be calculated. In transient situations, the command center 120 can query the message devices for their current location and make a similar calculation. Additionally or alternatively, the message device can also customize the message based on the relative position, rules and storage contained within the message device. Once the messaging devices within certain radii of the epicenter 105 are determined, appropriately worded and formatted messages can be formulated and transmitted accordingly. Additionally or alternatively, predetermined, locally stored messages can be triggered.

In some embodiments, one or more "effect radii" can be calculated (either predetermined based on known high-risk targets) or at the time of the event. Factors that may impact the various radii that are used to segment message receivers by geographic location can include the type of event, weather conditions, wind speed, time of day, etc. Once determined, the effect radii can be used to determine which entities (both fixed and transient) are within certain zones and, therefore, would receive different messages applicable to those locations. For example, train station 160 is within R1 distance from the epicenter 105, message receivers known to be located in station 160 (either based on their fixed location or GPS coordinates of transient entities) can be sent messages including evacuation instructions. Bus 170 and person 180 are, however, located at radius R2 and R3, respectively, and thus may not require evacuation instructions, but instead instructions on alternate routes out of the city. Thus, even though person 180 and a passenger waiting in station 160 may use the same message receiver and messaging service (e.g., both have the same model cellular telephones issued by the same cellular service company) they would receive very different messages. Additionally or alternatively, the message device can also customize the message based on the rules and render a unique version of the message, from the same initially received message. Similarly, an emergency medical technician 190 located outside the affected area can receive a message indicating the specific type of event and instructions to report to a particular location, such as the epicenter 105, a hospital or other location at which her assistance is needed.

A single entity can have multiple message receivers. For example, the school bus 170 may have a first receiver dedicated to the driver, such as a two way radio, and a second receiver for the passengers (e.g., a text-based message board) to facilitate the transmission of different messages to different audiences to avoid panic and provide appropriate instructions. Furthermore, because the bus 170 is located within the effect radius R3, the bus driver may be notified of the event, and to alter her route, with no message being sent to the message board in the bus, as the passengers do not need to be notified of the event. If, however, the bus 170 travels closer to the event (e.g., from effect radius R3 to R2) the passengers can receive updated messages instructing them to avoid station 160.

Figure 2:
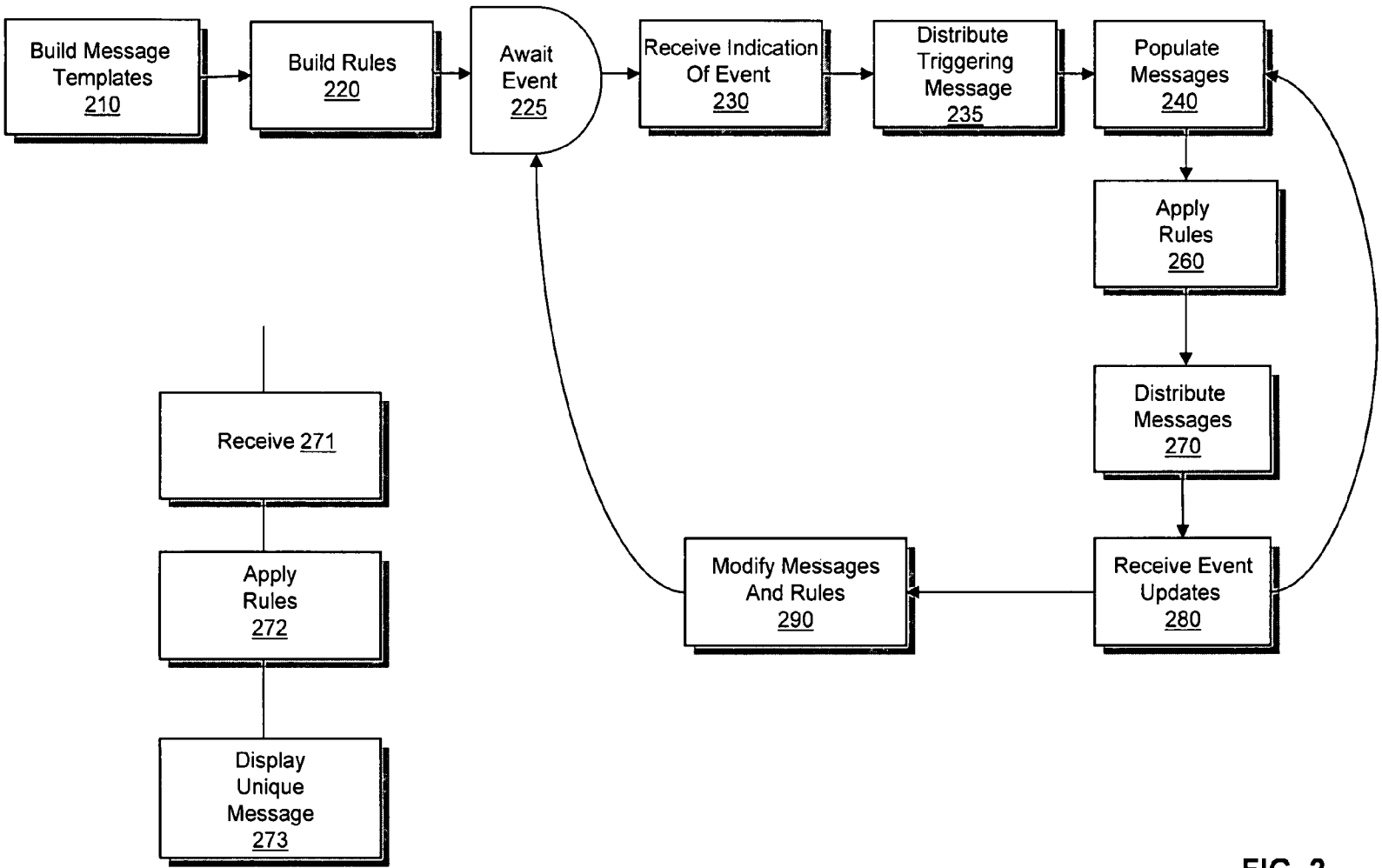
FIG. 2 is a flow chart depicting a process for distributing and/or triggering customized messages in accordance with one embodiment of the invention.

Referring to FIG. 2, a process for building and distributing timely, targeted messages during an emergency combines a preparation sub-process and an execution process. The preparation sub-process includes building message templates (step 210) that are used as a basis for building event-driven, recipient-specific messages. For example, the templates can include static text to be included in a large set (or every) message such as an emergency telephone number, placeholders for dynamic text that is provided when the message is compiled or rendered by the receiving device, as well as placeholders for images such as maps, video, and audio files.

In addition to building message templates, rules are built (step 220) that are used to govern message compilation and transmission both prior to and during an emergency. For example, rules can be formulated that instruct the system to send certain messages to certain message receivers based on the message content, the messaging modality used by a particular receiver, and/or its location with respect to the epicenter. Additionally or alternatively, the rules would be stored and applied within the message receiver.

The template can also include dynamic text such as a date/time field that is replaced with the current date and time when the message is displayed. Information specific to the receiving device, the type of event and/or persons associated with the device can also be included in the message templates. For example, an event type field can be used as a placeholder for text specific to the event, such as "fire," "earthquake" or "bomb threat." In other cases, the dynamic text can be a name and evacuation instructions (e.g., "please proceed to the SOUTH exit of TERMINAL B"). Once the messages and rules are established, and while the system is awaiting the indication of an event (step 225) they can be periodically updated to account for changing circumstances related to the receivers and/or modifications to evacuation plans and muster locations.

Upon receiving an indication of the occurrence of an event (step 230) the message templates, event data, and rules are used to compile the messages (step 240) and the rules are applied (step 260) to customize the messages for particular message receivers and to determine the proper audience and transmission modality. Optionally, after step 230, a triggering message or signal may be distributed (step 235) to trigger the compilation of messages or the generation of the messages at the message receivers. The messages are distributed (step 270) accordingly. In some embodiments, the messages are triggered at specific message receivers, the messages unique to and resident at the message receiver. In some embodiments, the message is received by the message receiver (step 271) and further rules applied (step 272) before the message is rendered (step 273). In some embodiments, updated information is received about the event, (step 280) and the messages can be repopulated and the rules reapplied, such that updated messages are distributed with the most current information. For example, if the command center receives an indication that a fire has spread to a particular portion of a building, messages that previously instructed people to proceed to a first exit may be altered based on this new information, and thus subsequent messages can instruct people to use an alternate exit. After the event is over, the messages and rules can be modified (step 290) to account for inaccurate rules and newly learned information such that if a subsequent event occurs, the messages will be based on lessons learned from the previous event.

One example of how the techniques described above could be implemented is in the unfortunate event that a bomb was detonated at a train station. A typical train station would likely include message receivers such as fixed message boards, an audio notification system for the building and the trains (both in and outside the station), two-way radios carried by station personnel and law enforcement, as well as cellular telephones and text-based messaging devices being carried by the general population. As examples, the fixed message board can be sent a message indicating the evacuation routes out of the building, audio notification systems on trains in the station can be sent messages indicating how to get off the train and where to proceed, and trains just outside the station can be sent messages that there is a delay and to remain seated on the train. In contrast, conventional systems send either generic messages that include little or no actionable information, or first send a message to a conductor who then must relay the information to the passengers. These approaches either put lives at risk by not providing timely, actionable information, or rely on human operators who may inadvertently provide inaccurate information, or in some cases, be incapacitated.

Furthermore, individuals in or near the train station can be sent different messages depending on attributes associated with them. For example, any passengers in the train station would receive messages (on, for example, their cell phone or PDA) instructing them to evacuate the premises, and, based on the location of the bomb, provide directions to the nearest mustering station. However, by using the current GPS coordinates associated with the passenger's cellular telephone, for example, a passenger that is outside or just approaching the train station will be sent a different message that indicates that the station should be avoided, and to find alternate means of transportation. Thus, two individuals that, other than their proximity to the epicenter of the event, may be exactly alike (e.g., carrying the same phone, with the same job, etc.) will receive different messages.

Similarly, two passengers in the train station can receive different messages depending on their roles. Like the EMT noted above, law enforcement personnel in the station can receive messages detailing the type of event, mustering instructions based on a previously determined plan, and a map of the affected area. In some embodiments, common messages may be received, however different rules are applied at the message receiver depending on their roles. Conversely, members of the general public (and public message boards) can receive specific instructions on the best evacuation routes and directions to nearby hospitals. Further, in instances where the sensing devices can provide detailed information about a location (e.g., a blocked exit or smoke-filled room) the evacuation instructions can be tailored to the specific event, thus avoiding instructing people to stairways or exits that are not viable.

Figure 3:
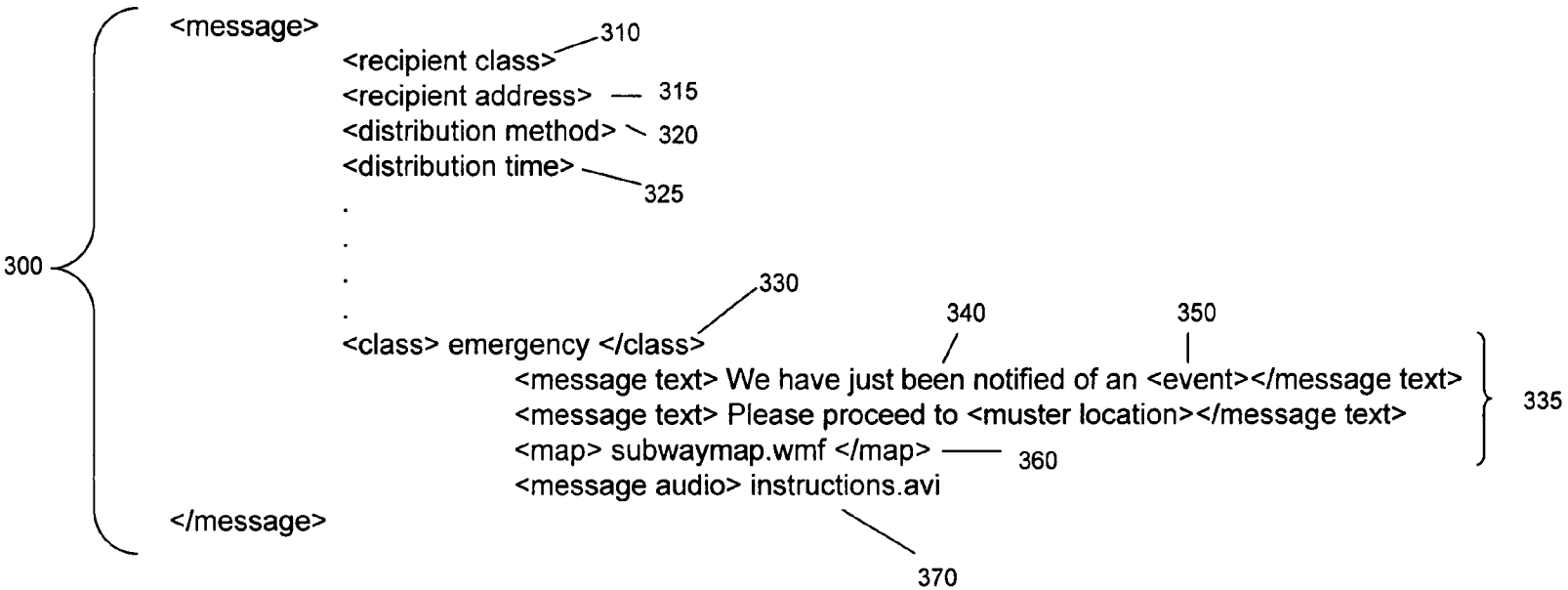
FIG. 3 illustrates a message structure for messages distributed in accordance with one embodiment of the invention.

FIG. 3 illustrates one possible embodiment of a message format 300 used to create and transmit the messages. A tag-based format, such as, for example, XML, can be used to define data elements relating to broadcasting messages relating to catastrophic events. Using such a format allows the messages to be transmitted over TCP/IP-based networks and rendered on devices such as WAP-enabled phones, PDAs, and virtually any device that includes an embedded browser such as Internet Explorer or Firefox. Tag 310 provides a recipient class that can be used to determine which individual or individuals are to receive the message. Examples of values for the <recipient class> tag can be "FIRST RESPONDERS," "MILITARY," "ALL," or in some cases an individual person's name. Tag 315 provides a recipient address element that can be used instead of or in conjunction with the recipient class tag 310 to address the message using, for example, an IP address, MAC address, device name, or other virtual address assigned at the hardware or software level. A distribution method tag 320 provides the means to set one or more messaging modalities for delivery and/or triggering of the message, including SMTP, GSM, CDMA, TDMA, and others. The distribution time tag 325 allows the messages to be sent at absolute times (e.g., noon), times relative to the event (T+1 hr), at some periodicity, (every 30 seconds), and any combination thereof. The tag 330 provides additional means to assign a class to the message, such as "emergency" or "information only," as well as other classes that can be used, for example, to prioritize or route the message.

Continuing with FIG. 3, the message 300 also includes a message body 335. The message body 335 can include various components, including static text 340, placeholder tag 350 for inserting dynamic text when the message is compiled and/or rendered, video tag 360 for inserting still and moving video images such as maps showing escape routes, and audio tag 370 that indicates the presence of an audio file embedded in the message that can be played, for example, over a loudspeaker or as part of a cellular telephone message.

Figure 4:
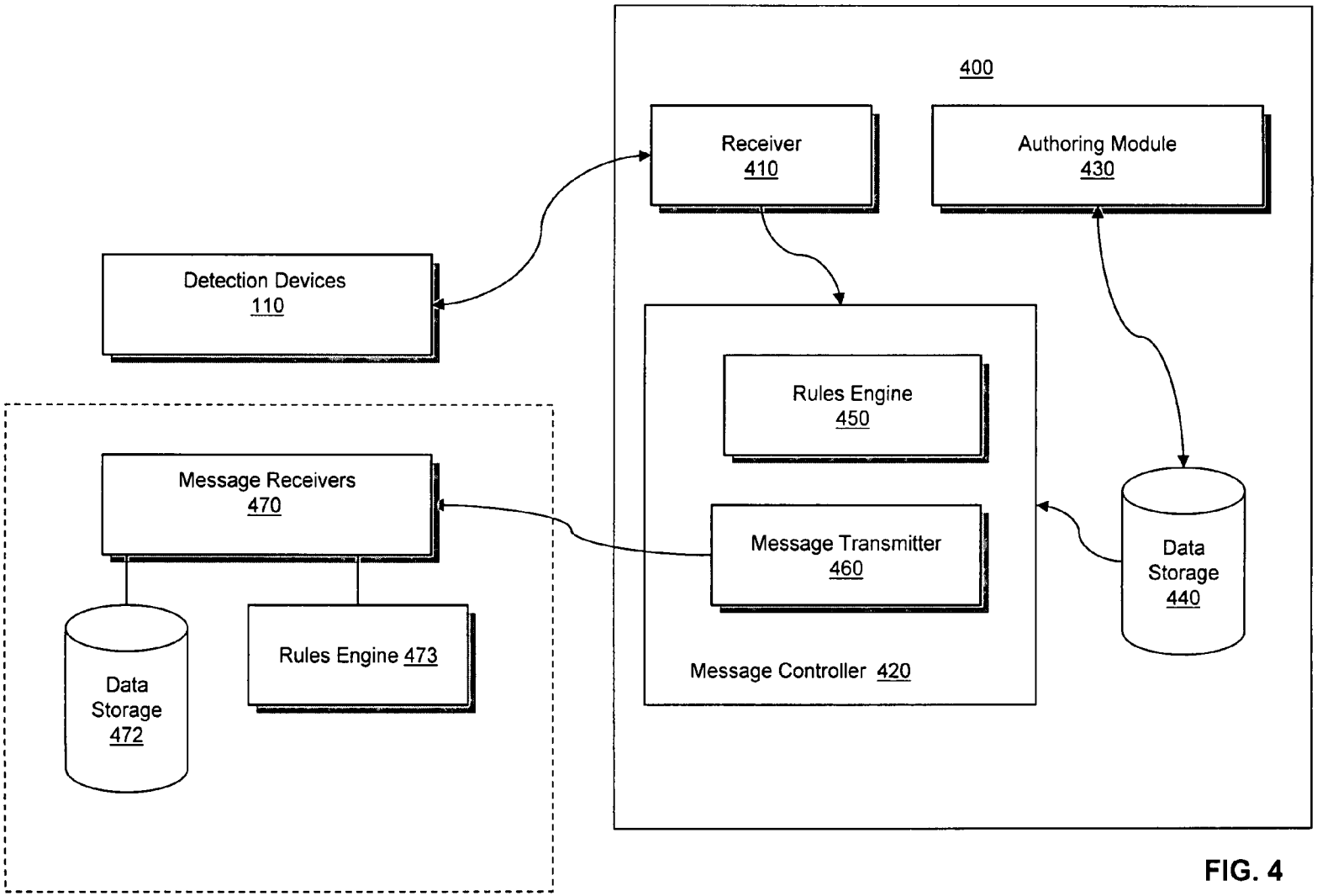
FIG. 4 is a schematic illustration of one embodiment of a system adapted to practice the methods of the present invention.

A representative system implementing the techniques set forth above is shown in FIG. 4. The system 400 interfaces with one or more detection devices 110 via a receiver 410. As described above, the detection devices 110 may comprise any device capable of receiving information on events, such as explosions, earthquakes, hostage situations, hijackings, and the like. The receiver 410 may comprise an RF receiver, web server, SMTP gateway, router, or other device used to send and receive messages over a communications network, and may be part of or in electronic communication with a message controller 420. The system 400 can also include an authoring module 430 that allows system administrators and users to build the message templates and rules, compose text, create and capture audio and video files, and store them in a data storage module 440 for subsequent retrieval by the message controller 420. Individual authoring modules 430 can be built into the message receivers.

The system 400 further comprises a rules engine 450 in electronic communication with the receiver 410 and data storage module 440. The rules engine 450 may be any device capable of executing one or more process or sub-process according to software instructions stored in or provided to the system 400 and comprise means for modifying message contents and/or delivery instructions in response to signals from the receiver 410 and message controller 420. The system also includes a message transmitter 460 for transmitting the compiled messages to various message receivers 470 using the methods described above. In some embodiments, the message receiver 470 incorporates further rules engines 473 and data storage 472. In some embodiments, the system 400 also includes a logging server for maintaining log files of each event that has been detected and each message that was sent in response thereto.

In some embodiments, the data processing device 400 and message receivers 470 may implement the functionality of the methods of the present invention as one or more software programs on a general purpose computer using analog and/or digital circuitry adapted to implement the functionality of one or more of the methods of the present invention. In addition, such a program may set aside portions of a computer's random access memory to provide control logic that affects one or more of the detection of events, compiling and customizing of messages based on message templates and recipient and event-specific attributes and executing rules that determine the delivery of messages. In such an embodiment, the program may be written in any one of a number of high-level languages, such as FORTRAN, PASCAL, C, C++, C#, java, LISP, PERL, Tcl, or BASIC. Further, the program can be written in a script, macro, or functionality embedded in commercially available software, such as EXCEL or VISUAL BASIC. Additionally, the software could be implemented in an assembly language directed to a microprocessor resident on a computer. For example, the software can be implemented in Intel 80×86 assembly language if it is configured to run on an IBM PC or PC clone. The software may be embedded on an article of manufacture including, but not limited to, "computer-readable program means" such as a floppy disk, a hard disk, an optical disk, a magnetic tape, a PROM, an EPROM, or CD-ROM.

In another aspect, the present invention provides an article of manufacture where the functionality of a method of the present invention is embedded on a computer-readable medium, such as, but not limited to, a floppy disk, a hard disk, an optical disk, a magnetic tape, a PROM, an EPROM, CD-ROM, or DVD-ROM. The functionality of the method may be embedded on the computer-readable medium in any number of computer-readable instructions, or languages such as, for example, FORTRAN, PASCAL, C, C++, C#, java, LISP, PERL, Tcl, BASIC and assembly language. Further, the computer-readable instructions can, for example, be written in a script, macro, or functionally embedded in commercially available software (such as, e.g., EXCEL or VISUAL BASIC).

While the invention has been particularly shown and described with reference to specific embodiments, it should be understood by those skilled in the art that various changes in form and detail may be made therein without departing from the spirit and scope of the invention as defined by the appended claims.

What is claimed is:

1. A method for providing information related to an emergency event, the method comprising:

providing a set of messages related to responding to the emergency event;

providing a set of rules relating to the distribution, compilation, and customization of the messages;

receiving an indication that the emergency event has occurred; and in response to the received indication, transmitting at least one of the messages to at least one message receiver based at least in part on at least one attribute of the message receiver to at least one of instruct and inform recipients of the messages of the emergency event and the action to be taken in response to the emergency event, wherein the rules are stored on the at least one message receiver.

2. The method of claim 1 further comprising the steps of:

receiving a subsequent indication of an occurrence of a second emergency event; and in response to the received subsequent indication, transmitting one or more subsequent messages to the plurality of message receivers.

3. The method of claim 1 wherein the rules relating to the distribution, compilation, and customization of the messages comprise information related to at least one attribute of the emergency event.

4. The method of claim 3 wherein the at least one attribute of the emergency event is selected from the group consisting of geographic attributes, classification attributes, temporal attributes, and functional attributes.

5. The method of claim 1 wherein the rules relating to the distribution, compilation, and customization of the messages comprise information related to at least one attribute of the message receiver.

6. The method of claim 5 wherein the at least one attribute of the message receiver is selected from the group consisting of geographic attributes, classification attributes, temporal attributes, operator attributes, and functional attributes.

7. The method of claim 1 wherein the message receivers are located at a fixed location.

8. The method of claim 1 wherein the message receivers are transitory.

9. The method of claim 1 wherein the message receivers comprise at least one of an audio broadcast apparatus and a video broadcast apparatus.

10. The method of claim 1 wherein the rules are transmitted over a communications network.

11. The method of claim 10 wherein the communications network comprises at least one of a local area computer network, a wide-area computer network, an intranet, and the Internet.

12. The method of claim 11 wherein the communications network comprises wireless communication capabilities.

13. The method of claim 1 wherein the rules comprise forward-chaining rules.

14. The method of claim 1 wherein the messages are transmitted using a mark-up language.

15. The method of claim 1 wherein the indication of the occurrence of the event is received via at least one of a telephone call, instant message, video surveillance event, manual indication.

16. The method of claim 1 wherein the message is formulated subsequent to the occurrence of the emergency event.

17. The method of claim 1 further comprising transmitting at least one subsequent message to one of the plurality of message receivers based, at least in part, on an updated attribute of the message receiver.

18. The method of claim 17 wherein the updated attribute of the message receiver is selected from the group consisting of the location of the message receiver and a status indication received relating to the message receiver.

19. The method of claim 1 wherein the messages comprise at least one of static text, context-based text, static images, and context-based images.

20. The method of claim 1 further comprising the steps of:

receiving the message at the message receiver; and customizing, by the message receiver, the received message based at least in part on the rules and at least one attribute of the message receiver.

21. A system for providing messages relating to the occurrence of an emergency event, the system comprising:

a data storage module for storing a plurality of messages related to responding to the emergency event and rules relating to the distribution, compilation, and customization of the messages;

a receiver for receiving an indication of the occurrence of the emergency event;

a rules engine for determining, based on the received indication and rules, at least one message to be transmitted to at least one message receiver; and a transmitter for transmitting at least one of the messages to the at least one message receiver based at least in part on at least one attribute of the message receiver to at least one of instruct and inform recipients of the messages of the emergency event and the action to be taken in response to the emergency event, wherein the data storage module is located at the at least one message receiver.

22. The system of claim 21 further comprising a message authoring module for composing the messages.

23. The system of claim 21 further comprising a geographic determination module for determining a physical location of the message receivers based on attributes of the message receivers.

24. The system of claim 21 further comprising a geographic determination module for determining a physical location of the emergency event based on the attributes of the received indication of the occurrence of the emergency event.

25. The system of claim 21 wherein the message receivers further comprise at least one audio/visual apparatus.

26. The system of claim 21 wherein the messages receivers are identified using a unique hardware address.

27. The system of claim 21 wherein the transmitter transmits the messages using at least one of a radio signal, television signal, and TCP/IP message.

* * * * *